US007520934B2

(12) United States Patent
Nojo et al.

(10) Patent No.: US 7,520,934 B2
(45) Date of Patent: Apr. 21, 2009

(54) GRAVURE COATING APPARATUS

(75) Inventors: Kazuhiko Nojo, Shizuoka (JP); Tomonari Ogawa, Shizuoka (JP); Takayuki Nakanishi, Shizuoka (JP); Masafusa Murakami, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 486 days.

(21) Appl. No.: 11/180,537

(22) Filed: Jul. 14, 2005

(65) Prior Publication Data

US 2006/0016392 A1 Jan. 26, 2006

(30) Foreign Application Priority Data

Jul. 21, 2004 (JP) ..... 2004-212634

(51) Int. Cl.
*B05C 1/00* (2006.01)

(52) U.S. Cl. ..... 118/212; 118/261

(58) Field of Classification Search ..... 118/261, 118/244, 211, 212; 427/428.13, 428.14
See application file for complete search history.

(56) References Cited

U.S. PATENT DOCUMENTS 4,518,637 A * 5/1985 Takeda et al. ..... 427/359
5,633,045 A * 5/1997 Smith et al. ..... 427/428.17
5,820,935 A * 10/1998 Kashiwabara et al. ..... 427/359
6,471,733 B1 10/2002 Cooper

FOREIGN PATENT DOCUMENTS

JP 63-194766 8/1988
JP 4-41764 4/1992

* cited by examiner

*Primary Examiner*—Brenda A Lamb
(74) *Attorney, Agent, or Firm*—Young & Thompson

(57) ABSTRACT

A gravure coating apparatus containing a gravure roll, a manifold block for continuously coating a solution on an outer peripheral surface of the gravure roll 15 by immersing a lower part of the outer peripheral surface in the solution, and a doctor blade for scraping off excess solution, a surface of a flexible strip support conveyed to the gravure roll being made in contact with the outer peripheral surface of the gravure roll to transfer and coat a prescribed amount of the solution on the surface of the flexible strip support. The apparatus further contains a dam block which extends from the manifold block on a side where the outer peripheral surface of the gravure roll moves out from the manifold block by rotation of the gravure roll.

19 Claims, 5 Drawing Sheets

GRAVURE COATING APPARATUS

BACKGROUND OF THE INVENTION

1. Technical Field of the Invention

The present invention relates to a gravure coating apparatus for coating uniformly a coating solution on a surface of a support continuously conveyed.

2. Description of the Related Art

A gravure coating apparatus has been known as an apparatus for coating a coating solution on a surface of a flexible strip support. In the gravure coating apparatus, as shown in FIG. 3, a gravure roll 1 rotationally driven in the direction shown by the arrow A is immersed in a liquid pool 2*a*, which is a recession formed in a manifold block 2 while maintaining a certain distance to the outer peripheral surface of the gravure roll 1, whereby the coating solution L is applied to the outer peripheral surface of the gravure roll 1. Thereafter, as shown in FIG. 4, the coating solution L held in cells carved on the outer peripheral surface of the gravure roll 1 is transferred and coated on a flexible strip support 5, while a redundant part of the coating solution L coated on the outer peripheral surface of the gravure roll 1 is scraped off with a doctor blade 4, which is pressed onto the outer peripheral surface of the gravure, roll 1 (as described, for example, in JP-U-4-41764).

The coating solution L thus coated on the outer peripheral surface of the gravure roll 1 and then scraped off with the doctor blade 4 is collected to a recovery pan 6 through an outer surface 2*c* of a part 2*b* where the outer peripheral surface of the gravure roll moves out of the manifold block 2.

In the gravure coating apparatus of this kind, as shown in FIG. 5, the redundant coating solution recovered by scraping off with the doctor blade 4 with a relatively large length forms a number of fluxes Ls in longitudinal stripe form due to contraction flows with small distances in the transversal direction caused by action of surface tension. The fluxes Ls in longitudinal stripe form make unevenness in pressure of the coating solution onto the back surface of the tip end part of the blade, which causes unevenness in amount of the coating solution passing through the doctor blade 4, whereby the transferred and coated amount of the coating solution on the surface of the flexible strip support 5 is disproportionated in the transversal direction.

In order to prevent the problem, it has been practiced such a measure as shown in FIG. 6 that a curved coating solution guide 7 is provided on the manifold block 2 on the side where the outer peripheral surface of the gravure roll moves out, while maintaining a certain distance with the outer peripheral surface of the gravure roll 1, and the tip end part of the coating solution guide 7 is extended to a position immediately near the contact point of the doctor blade 4 and the gravure roll 1, whereby the fluxes Ls in longitudinal stripe form of the coating solution L thus scraped off and recovered with the doctor blade 4 are prevented from influencing on the transferred and coated amount of the coating solution L (as described, for example, in JP-A-63-194766).

However, in the case where the coating solution guide 7 is extended to a position immediately near the contact point of the doctor blade 4 and the gravure roll 1 for suppressing the fluxes Ls in longitudinal stripe form of the recovered coating solution L from occurring, the liquid pressure and the liquid resistance of the coating solution L passing through the coating solution guide 7 are increased when the coating solution L has a high viscosity, and as a result, there is such a possibility that the transferred and coated amount of the coating solution L on the flexible strip support 5 becomes uneven due to deformation of the doctor blade 4. When the coating solution L passing through the coating solution guide 7 has a low viscosity, furthermore, there is such a possibility that the coating solution L is not favorably charged in the gap between the outer peripheral surface of the gravure roll 1 and the coating solution guide 7. Moreover, there may be problems in workability, cleanability, detaching operationality and maintenancability of the coating solution guide 7 depending on the shape thereof.

SUMMARY OF THE INVENTION

The invention has been developed under the circumstances, and an object thereof is to provide such a gravure coating apparatus that can suppress the fluxes in longitudinal stripe form of a coating solution thus scraped off and recovered with a doctor blade and deformation of the doctor blade from influencing on the transferred and coated amount of the coating solution, whereby the coating solution can be uniformly transferred and coated on a surface of a flexible strip support.

The object of the invention can be attained by a gravure coating apparatus having the following constitution.

(1) A gravure coating apparatus comprising a gravure roll rotationally driven at a prescribed peripheral velocity, a manifold block for continuously coating a coating solution on an outer peripheral surface of the gravure roll by immersing a lower part of the outer peripheral surface in the coating solution, and a doctor blade for scraping off a redundant part of the coating solution coated on the outer peripheral surface from an upper part of the outer peripheral surface of the gravure roll rotationally displaced upward having the coating solution coated thereon, a surface of a flexible strip support conveyed to the gravure roll being made in contact with the outer peripheral surface of the gravure roll to transfer and coat a prescribed amount of the coating solution on the surface of the flexible strip support, in which the apparatus further comprises a dam block extending from the manifold block on a side where the outer peripheral surface of the gravure roll moves out from the manifold block by rotation of the gravure roll, the dam block having a tip end positioned above an axial center of the gravure roll and below a scraping point where the redundant part of the coating solution on the outer peripheral surface of the gravure roll is scraped off with the doctor blade.

According to the gravure coating apparatus, the tip end of the dam block formed on the manifold block on the side where the outer peripheral surface of the gravure roll moves out is positioned above the axial center of the gravure roll and below the scraping point where the redundant part of the coating solution on the outer peripheral surface of the gravure roll is scraped off with the doctor blade, whereby even in the case where the coating solution has a high viscosity, the liquid pressure and the liquid resistance of the coating solution are suppressed from being increased to prevent the doctor blade from being deformed, and the fluxes in longitudinal stripe form of the coating solution scraped off and recovered with the doctor blade are largely suppressed from occurring. Consequently, the coating solution can be uniformly transferred and coated on the surface of the flexible strip support.

(2) The gravure coating apparatus as described in (1), wherein when a first line connects the tip end of the dam block and the axial center of the gravure roll and a second line connects the scraping point where the redundant part of the coating solution is scraped off with the doctor blade and the axial center of the gravure roll, an angle defined between the first line and the second line is 40° or less.

According to the gravure coating apparatus, assuming that the first line connects the tip end of the dam block and the axial center of the gravure roll, and the second line connects the scraping point where the redundant part of the coating solution is scraped off with the doctor blade and the axial center of the gravure roll, the angle formed by the first and second lines is 40° or less, whereby even in the case where the coating solution has a high viscosity, the liquid pressure and the liquid resistance of the coating solution are suppressed from being increased to prevent the doctor blade from being deformed, and the fluxes in longitudinal stripe form of the coating solution scraped off and recovered with the doctor blade are largely suppressed from occurring.

(3) The gravure coating apparatus as described in (1), wherein the tip end of the dam block is positioned below the scraping point where the redundant part of the coating solution is scraped off with the doctor blade, with a vertical distance of from 3 to 25 mm.

According to the gravure coating apparatus, the tip end of the dam block is positioned below the scraping point where the redundant part of the coating solution is scraped off with the doctor blade, with a vertical distance of from 3 to 25 mm, whereby even in the case where the coating solution has a high viscosity, the liquid pressure and the liquid resistance of the coating solution are suppressed from being increased to prevent the doctor blade from being deformed, and the fluxes in longitudinal stripe form of the coating solution scraped off and recovered with the doctor blade are largely suppressed from occurring.

(4) The gravure coating apparatus as described in (1), wherein when a first line connects the tip end of the dam block and the axial center of the gravure roll and a second line connects the scraping point where the redundant part of the coating solution is scraped off with the doctor blade and the axial center of the gravure roll, the first line and the second line form an angle of 40° or less, and the tip end of the dam block is positioned below the scraping point where the redundant part of the coating solution is scraped off with the doctor blade, with a vertical distance of from 3 to 25 mm.

According to the gravure coating apparatus, assuming that the first line connects the tip end of the dam block and the axial center of the gravure roll, and the second line connects the scraping point where the redundant part of the coating solution is scraped off with the doctor blade and the axial center of the gravure roll, the angle formed by the first and second lines is 40° or less, and the tip end of the dam block is positioned below the scraping point where the redundant part of the coating solution is scraped off with the doctor blade, with a vertical distance of from 3 to 25 mm, whereby even in the case where the coating solution has a high viscosity, the liquid pressure and the liquid resistance of the coating solution are suppressed from being increased to prevent the doctor blade from being deformed, and the fluxes in longitudinal stripe form of the coating solution scraped off and recovered with the doctor blade are largely suppressed from occurring.

(5) The gravure coating apparatus as described in one of (1) to (4), wherein the dam block extends upward with an increasing gap between the outer peripheral surface of the gravure roll and the dam block.

According to the gravure coating apparatus, the dam block extends upward with an increasing gap between the outer peripheral surface of the gravure roll and the dam block, whereby the effect of stable feed of the coating solution can be further enhanced irrespective to the viscosity of the coating solution.

(6) The gravure coating apparatus as described in one of (1) to (5), wherein the gravure roll is rotationally driven in a direction opposite to a conveying direction of the flexible strip support.

According to the gravure coating apparatus, the gravure roll is rotationally driven in a direction opposite to a conveying direction of the flexible strip support, whereby the coating operation can be carried out by the reverse kiss coating system.

(7) The gravure coating apparatus as described in one of (1) to (5), wherein the gravure roll is rotationally driven in the same direction as a conveying direction of the flexible strip support.

According to the gravure coating apparatus, the gravure roll is rotationally driven in the same direction as a conveying direction of the flexible strip support, whereby the coating operation can be carried out by the forward kiss gravure system.

(8) The gravure coating apparatus as described in one of (1) to (7), wherein the dam block is provided at least on an upstream side of a rotation direction of the gravure roll.

According to the gravure coating apparatus, the dam block is provided at least on an upstream side of a rotation direction of the gravure roll, whereby the coating solution is stably fed to the gravure roll. Furthermore, the feed of the coating solution can be further stabilized by providing the dam blocks on both the upstream side and the downstream side.

(9) The gravure coating apparatus as described in one of (1) to (8), wherein the gravure roll has a diameter of from 20 to 300 mm.

According to the gravure coating apparatus, the effect of stable feed of the coating solution can be still further enhanced irrespective to the viscosity of the coating solution by the synergistic effect with such a configuration that the distance between the dam block and the gravure roll is increased upward.

(10) The gravure coating apparatus as described in one of (1) to (9), wherein the apparatus further comprises solution outflow preventing plates disposed on both ends of a space formed by the dam block and the gravure roll.

According to the gravure coating apparatus, solution outflow preventing plates are disposed on both ends of a space formed by the dam block and the gravure roll, whereby the coating solution can be prevented from outflowing.

According to the gravure coating apparatus of the invention, the dam block extends from the manifold block on a side where the outer peripheral surface of the gravure roll moves out from the manifold block by rotation of the gravure roll, and the tip end of the dam block is positioned above the axial center of the gravure roll and below the scraping point where the redundant part of the coating solution on the outer peripheral surface of the gravure roll is scraped off with the doctor blade, whereby the fluxes in longitudinal stripe form of the coating solution caused by scraping off the redundant part of the coating solution with the doctor blade are largely suppressed from occurring owing to the selection of the positional relationship of the gravure roll opposed to the extended tip end of the part where the outer peripheral surface of the gravure roll moves out and the doctor blade, and thus the coating solution can be uniformly transferred and coated on the surface of the flexible strip support to improve the coating quality.

DETAILED DESCRIPTION OF THE INVENTION

The preferred embodiment for carrying out the invention will be described below with reference to the drawings.

Figure 1:
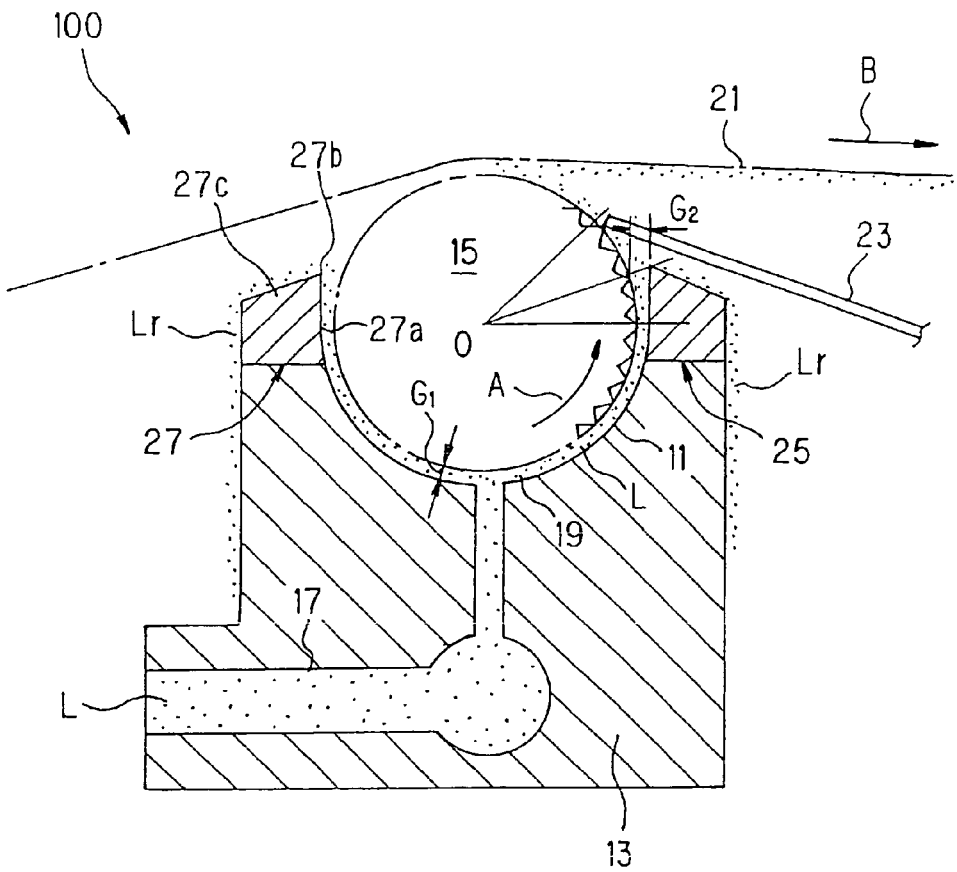
FIG. 1 is a cross sectional view showing a structure of a gravure coating apparatus according to an embodiment of the invention.
Figure 2:
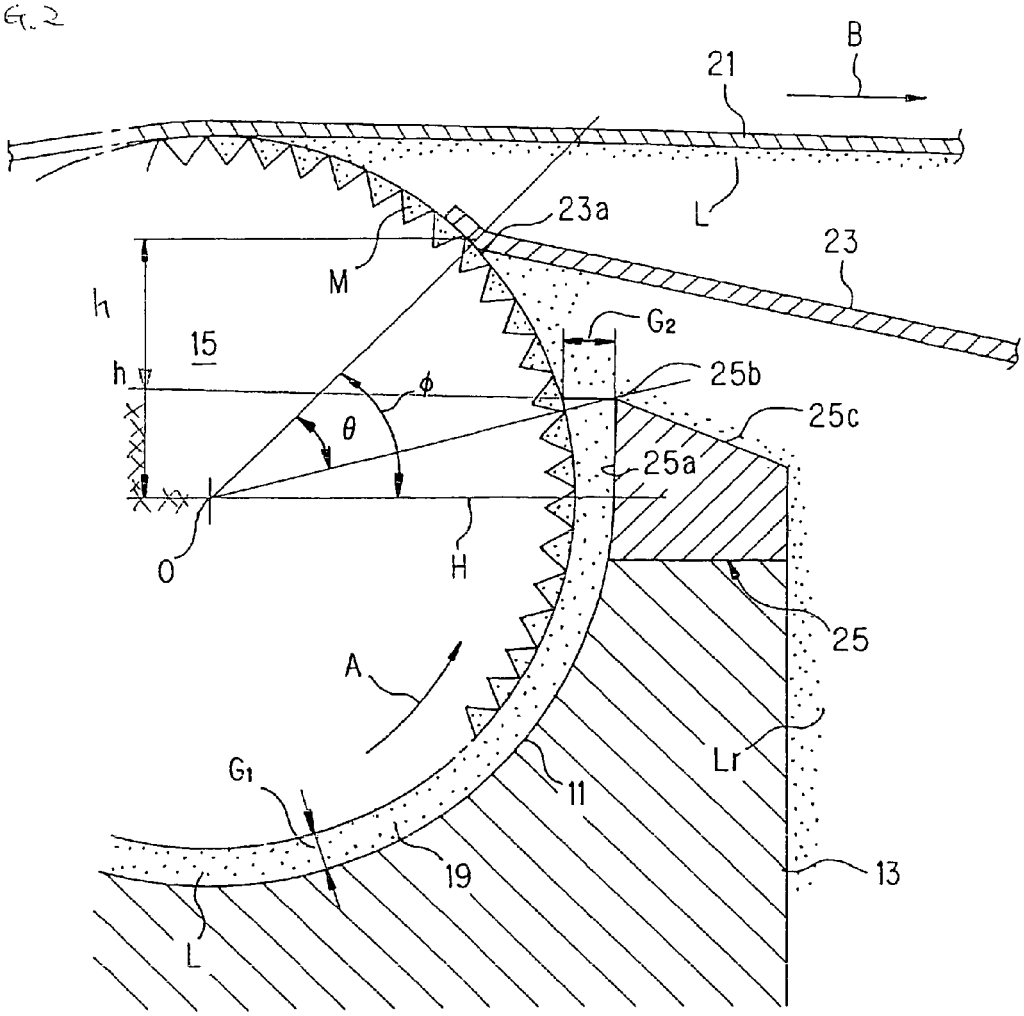
FIG. 2 is an enlarged cross sectional view showing a side where a coating solution is fed in the gravure coating apparatus according to an embodiment of the invention.
Figure 3:
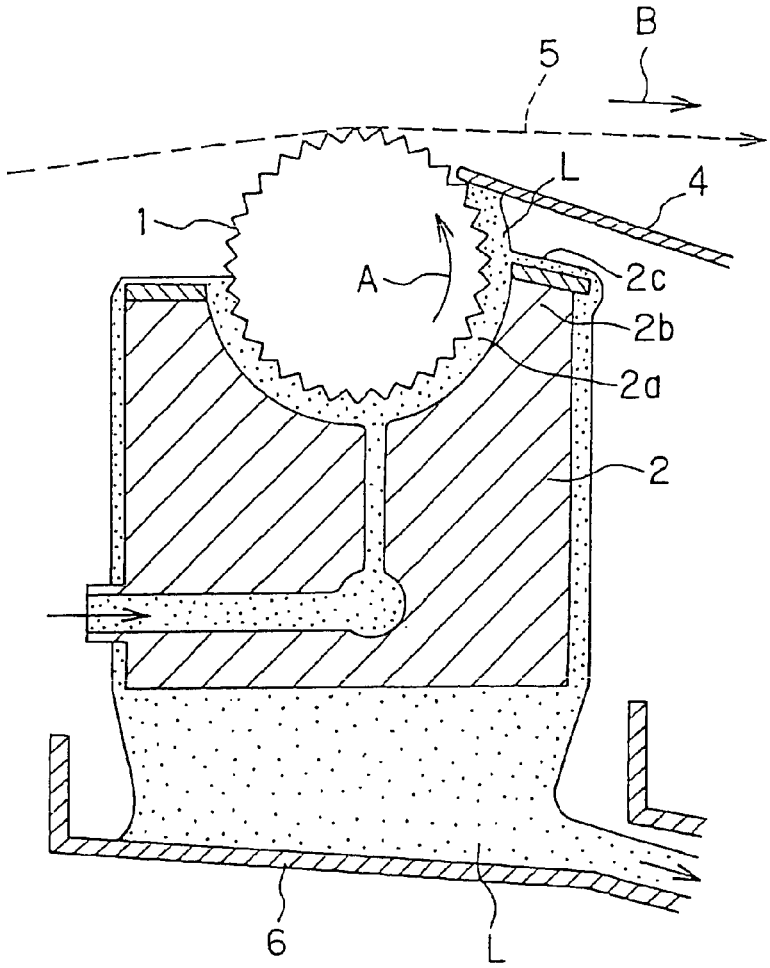
FIG. 3 (PRIOR ART)
FIG. 3 is a cross sectional view showing a structure of a related art gravure coating apparatus.
Figure 4:
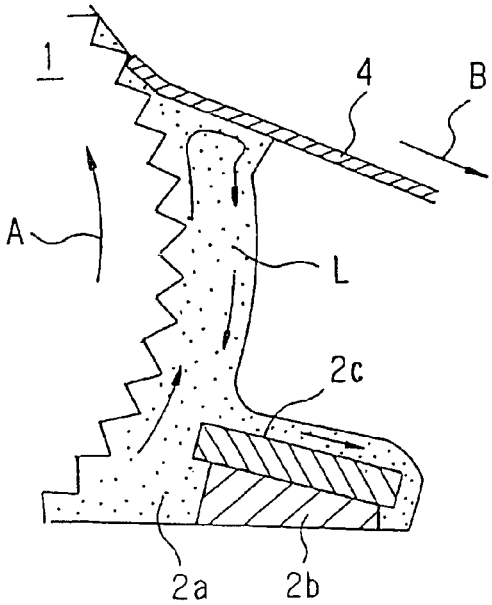
FIG. 4 (PRIOR ART)
FIG. 4 is an enlarged cross sectional view showing a side where a coating solution is fed in the related art gravure coating apparatus.
Figure 5:
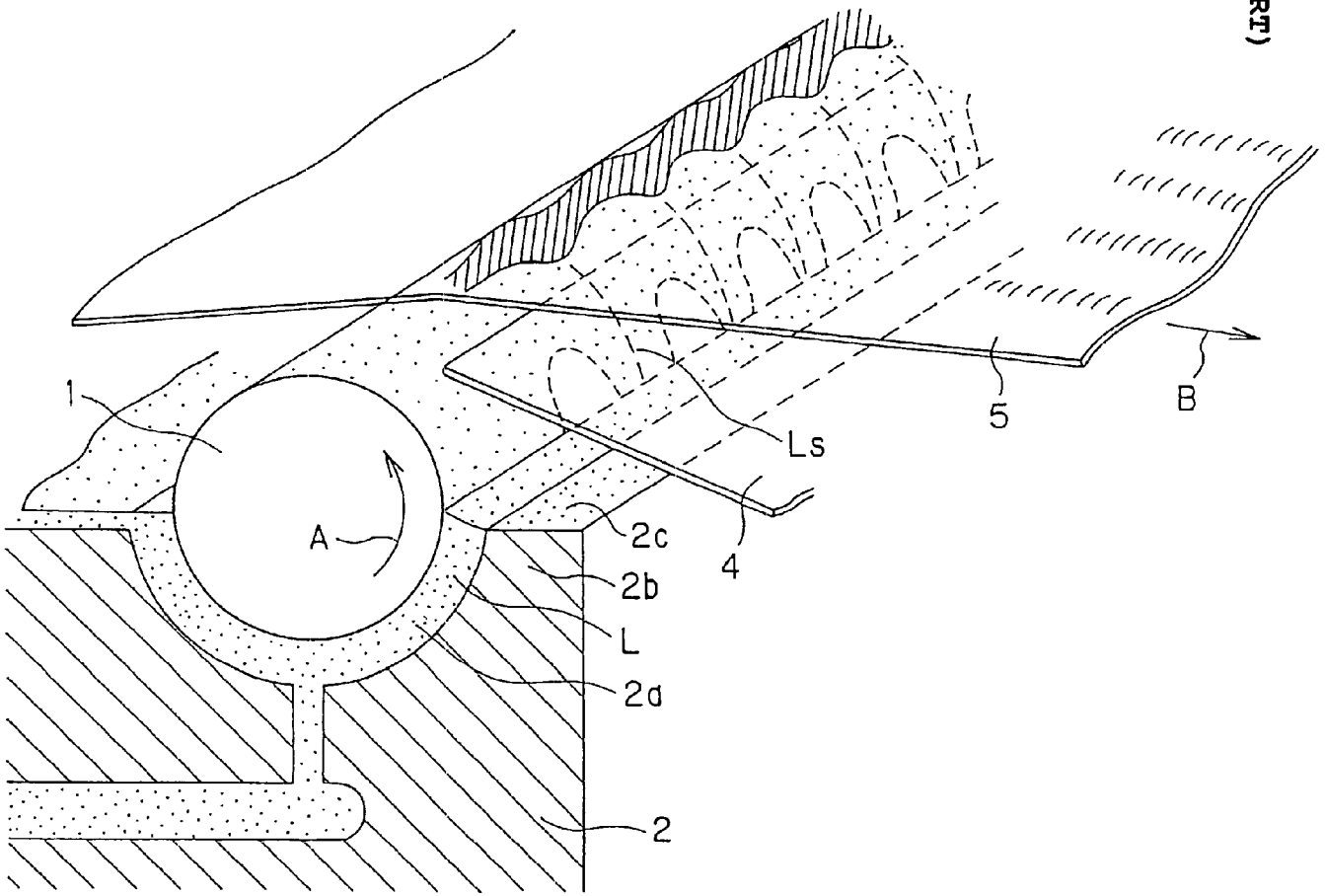
FIG. 5 (PRIOR ART)
FIG. 5 is a perspective view showing coating condition of a coating solution on a flexible strip support in a related art gravure coating apparatus.
Figure 6:
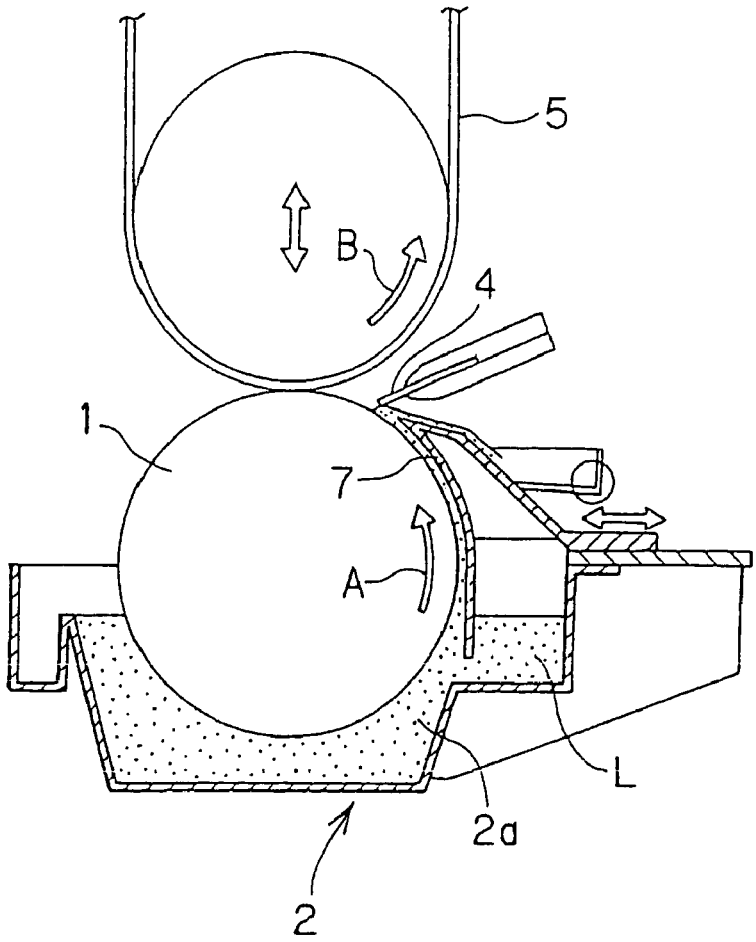
FIG. 6 (PRIOR ART)
FIG. 6 is a cross sectional view showing another example of a related art gravure coating apparatus.

FIG. 1 is a cross sectional view showing a gravure coating apparatus according to the embodiment, and FIG. 2 is an enlarged cross sectional view showing a side where a coating solution is fed in the gravure coating apparatus.

As shown in FIGS. 1 and 2, the gravure coating apparatus 100 of the embodiment has a manifold block 13 having a recessed part 11 having a substantially circular arc axial cross section.

A gravure roll 15 is disposed rotatablly in a direction shown by the arrow A in the recessed part 11 of the manifold block 13, and a gap G1 is provided between the outer peripheral surface of the gravure roll 15 and the inner peripheral surface of the recessed part 11.

The manifold block 13 further has a liquid feeding path 17 communicating to a liquid pool 19 formed by the gap G1 between the outer peripheral surface of the gravure roll 15 and the inner peripheral surface of the recessed part 11, and the coating solution L is continuously fed from an exterior to the liquid pool 19 through the liquid feeding path 17. Upon charging the coating solution L in the liquid pool 19, the lower part of the outer peripheral surface of the gravure roll is immersed in the coating solution L.

The gravure coating apparatus 100 according to an embodiment of the invention employs the reverse coating system, i.e., the so-called reverse kiss coating system, in which an upper part of the outer peripheral surface of the gravure roll 15 rotationally driven in the direction shown by the arrow A at a constant peripheral velocity is made in contact with a lower surface of a flexible strip support 21 conveyed in the direction opposite to the gravure roll, i.e., the direction shown by the arrow B, which is formed, for example, of a long paper sheet or a long plastic film, whereby the coating solution L is effectively transferred from the upper part of the outer peripheral surface of the gravure roll 15 to the lower surface of the flexible strip support 21.

As shown in FIG. 1 and the enlarged view of FIG. 2, the manifold block 13 further has a part 25 where the outer peripheral surface of the gravure roll moves out (dam block) disposed on the upstream side of the liquid pool 19, and a part 27 where the outer peripheral surface of the gravure roll moves in (dam block) disposed on the downstream side of the liquid pool 19, which are respectively formed as extended parts of the recessed part 11, whereby the liquid level in the liquid pool 19 is raised and maintained above an axial center O of the gravure roll 15. The part 25 where the outer peripheral surface of the gravure roll moves out and the part 27 where the outer peripheral surface of the gravure roll moves in have inner peripheral surfaces 25*a* and 27*a*, respectively, which extend upward to increase the gap G1 to the gap G2 between the outer peripheral surface of the gravure roll 15 and the inner peripheral surfaces above the axial center O of the gravure roll 15.

The gravure coating apparatus 100 according to the embodiment of the invention has a doctor blade 23 having a tip end part 23*a* capable of being in contact with the upper part of the outer peripheral surface of the gravure roll 15 in the axial direction thereof at a position above the part 25 where the outer peripheral surface of the gravure roll moves out, and the doctor blade is positioned at such a point that forms an angle θ of from 10 to 40° between the extended tip end part 25*b* of the part 25 where the outer peripheral surface of the gravure roll moves out and the scraping point 23*a* where the redundant part of the coating solution is scraped off with the doctor blade with respect to the axial center O of the gravure roll 15, and forms a vertical distance h of from 3 to 25 mm between the scraping point 23*a* where the redundant part of the coating solution is scraped off with the doctor blade and the extended tip end part 25*b*. In other words, assuming that the first line connects the tip end part 25*b* of the part 25 where the outer peripheral surface of the gravure roll moves out and the axial center O of the gravure roll 15, and the second line connects the scraping point 23*a* where the redundant part of the coating solution is scraped off with the doctor blade and the axial center O of the gravure roll 15, the angle formed by the first and second lines is 40° or less. It is preferred that the scraping point 23*a* where the redundant part of the coating solution is scraped off with the doctor blade is positioned at such a point that forms an angle ϕ of from 35 to 50° between the scraping point 23*a* where the redundant part of the coating solution is scraped off with the doctor blade and the horizontal line on the axial center O with respect to the axial center O.

The gravure coating apparatus 100 can exert effectiveness when the gravure roll 15 has a diameter D of from 20 to 300 mm. That is, in the case where the diameter D of the gravure roll 15 is less than 20 mm, the distance between the contact point with the doctor blade 23 and the center line of the gravure roll is substantially small to suppress the fluxes in longitudinal stripe form from occurring. In the case where the diameter D exceeds 300 mm, on the other hand, the coating solution thus scraped off runs off on the surface of the gravure roll 15 having a gentle slope owing to the dispositions thereof, whereby the fluxes in longitudinal form are difficult to occur in the vicinity of the doctor blade 23. The fluxes occur in the case where the doctor blade 23 is disposed at a lower position and the velocity of the coating solution thus running off is large, but in practice, the distance between the doctor blade and the coating position becomes large due to the large diameter D, whereby the fluxes are difficult to cause problems owing to the leveling effect of the coating solution or the like.

In order to raise certainly the liquid level on the part 25 where the outer peripheral surface of the gravure roll moves out, it is preferred that the part 27 where the outer peripheral surface of the gravure roll moves in has such a dimension that is symmetrical to the part 25 where the outer peripheral surface of the gravure roll moves out, with respect to the gravure roll 15. However, such a configuration may not be employed in the case where the liquid level on the part 25 is certainly raised according to the rotation of the gravure roll 15.

The redundant part of the coating solution Lr thus scraped off with the doctor blade 23 is guided to a recovery unit, which is not shown in the figure, through the outer slope surface 25*c* of the part 25 where the outer peripheral surface of the gravure roll moves out, and on the downstream side of the liquid pool 19, the overflow of the coating solution L thus fed is recovered by guiding to a recovery unit, which is not shown in the figure, through the outer slope surface 27*c* of the part 27 where the outer peripheral surface of the gravure roll moves in.

The mesh of the gravure roll 15 may be of various shapes, such as diagonal lines (diagonal line cups), lattices (trapezoidal cups) and pyramids (pyramid cups), and the effect of the invention can be exerted irrespective to the shape of the mesh. The size of the mesh M may be freely selected, for example, from a range of from #50 to #1500. In the case where the mesh M is too coarse, the coated amount becomes too large, and the coated amount distribution in the transversal direction becomes relatively small. However, the effect of the invention is basically not lost when the mesh M is too small.

The gravure roll 15 is formed ordinarily with a metal, and a ceramic gravure roll may also be employed, which is produced by providing a ceramic coating for wear prevention on a surface of a metallic roll, and forming a mesh M on the surface of the ceramic coating.

The gravure coating apparatus 100 may have solution outflow preventing plates disposed on both ends of a space formed by the dam block 25 and the gravure roll 15.

The coating solution L is not particularly limited and may have a solid content of from 0.01 to 80% by weight and a viscosity of from 0.1 to 20 cP. A binder for a solvent system maybe either a monomer or a polymer, and examples of the monomer include a monomer having two or more ethylenic unsaturated groups, an ester of a polyhydric alcohol and (meth) acrylic acid (such as ethylene glycol(meth)acrylate, 1,4-cyclohexane diacrylate, pentaerythritol tetra(meth)acrylate, pentaerythritol tri(meth)acrylate, trimethylolpropane tri (meth)acrylate, trimethylolethane tri(meth)acrylate, dipentaerythritol tetra(meth)acrylate, dipentaerythritol penta (meth)acrylate, dipentaerythritol hexa(meth)acrylate, 1,2,3-cyclohexane tetramethacrylate, polyurethane polyacrylate and polyester polyacrylate), vinylbenzene and a derivative thereof (such as 1,4-divinylbenzene, 2-acryloylethyl 4-vinylbenzoate and 1,4-divinylcyclohexanone), a vinylsulfone (such as divinylsulfone), an acrylamide (such as methylene bisacrylamide), and a methacrylamide.

In addition to or in place of the monomer having two or more ethylenic unsaturated groups, a crosslinking group may be introduced. Examples of the crosslinking group include an isocyanate group, an epoxy group, an aziridine group, an oxazoline group, an aldehyde group, a carbonyl group, a hydrazine group, a carboxyl group, a methylol group and an active methylene group. The monomer may contain vinylsulfonic acid, an acid anhydride, a cyanoacrylate derivative, melamine, an etherified methylol, an ester, a urethane, a metallic alkoxide, such as tetramethoxysilane, a dam-block isocyanate group. In the case where a monomer having the crosslinking group is used, it is necessary to effect crosslinking reaction by heating or the like after coating. Other examples of the monomer include bis(4-methacryloylthiophenyl)sulfide, vinylnaphthalene, vinylphenylsulfide and 4-methacryloxyphenyl-4'-methoxyphenylthio ether.

The coating solution may contain a crosslinking agent, a reaction initiator capable of accelerating curing through heat or light, organic or inorganic fine particles having a diameter of several micrometers and inorganic superfine particles having a diameter of 1 μm or less. Examples of the inorganic superfine particles include superfine particles having a particle diameter of 100 nm or less containing an oxide of titanium, aluminum, indium, zinc, tin, antimony or zirconium, preferably those particles having a particle diameter of 50 nm or less. Specific examples of the super fine particles include $TiO_2$, $Al_2O_3$, $In_2O_3$, ZnO, $SnO_2$, $Sb_2O_2$, ITO, $ZrO_2$. The coating solution L may contain inorganic fine particles or polymer fine particles having a particle diameter of 10 μm or less. The content of the inorganic superfine particles in the binder is preferably from 10 to 90% by weight, and more preferably from 20 to 80% by weight, based on the total weight of the coating solution L.

Examples of the inorganic fine particles include silica beads. Examples of the polymer fine particles include polymethyl methacrylate beads, polycarbonate beads, polystyrene beads, polyacrylstyrene beads and silicone beads.

Other examples of the binder include a crosslinkable fluorine polymer compound, such as a perfluoroalkyl group-containing silane compound (e.g., (heptadecafluoro-1,1,2,2-tetradecyl)triethoxysilane), and a fluorine-containing copolymer containing a fluorine-containing monomer component and a monomer component for imparting crosslinking capability as constitutional components.

Specific examples of the fluorine-containing monomer component include a fluoroolefin (such as fluoroethylene, vinylidene fluoride, tetrafluoroethylene, hexafluoroethylene, hexafluoropropylene, perfluoro-2,2-dimethyl-1,3-dioxol), a partially or completely fluorinated alkyl ester derivative of (meth)acrylic acid (such as Viscoat 6FM, produced by Osaka Organic Chemical Industry, Ltd., and M-2020, produced by Daikin Industries, Ltd.), and a partially or completely fluorinated vinyl ether.

Examples of the monomer component for imparting crosslinking capability include a (meth)acrylate monomer having a crosslinking functional group in the molecule thereof, such as glycidyl methacrylate, and a (meth)acrylate monomer (such as (meth)acrylic acid, methylol (meth)acrylate, hydroxyalkyl(meth)acrylate and allyl acrylate) having a carboxyl group, a hydroxyl group, an amino group, a sulfonic acid group or the like. The later can introduce a crosslinked structure after copolymerization, as described in JP-10-25388 and JP-A-10-147739.

In addition to a polymer containing the aforementioned fluorine-containing monomer as constitutional units, a copolymer with a monomer containing no fluorine atom may be used.

The monomer that may be used in combination is not particularly limited, and examples thereof include an olefin (such as ethylene, propylene, isoprene, vinyl chloride and vinylidene chloride), an acrylate ester (such as methyl acrylate, ethyl acrylate and 2-ethylhexyl acrylate), a methacrylate ester (such as methyl methacrylate, ethyl methacrylate, butyl methacrylate and ethylene glycol dimethacrylate), a styrene derivative (such as styrene, divinylbenzene, vinyltoluene and α-methylstyrene), a vinyl ether (such as methyl vinyl ether), a vinyl ester (such as vinyl acetate, vinyl propionate and vinyl cinnamate), an acrylamide (such as N-tert-butylacrylamide and N-cyclohexylacrylamide), a methacrylamide, and an acrylonitrile derivative.

As the solvent, an alcohol and a ketone are mainly used, and as the alcohol, methanol, ethanol, propanol, isopropanol and butanol are mainly used. As the ketone, methyl ethyl ketone, methyl isobutyl ketone and cyclohexanone are mainly used. In addition to these, toluene and acetone may be used. The solvent may be used solely or as a mixture thereof.

The flexible strip support 21 used in the embodiment may be in a sheet form or a continuous film in a strip form, and may be formed of a paper base. The flexible strip support used herein preferably has a width of 3 m at most and a thickness of from 5 to 300 μm, but is not particularly limited.

The flexible strip support 21 is appropriately selected depending on purposes, and specifically, a transparent support may be used. Preferred examples of the transparent support include a plastic film. Examples of a polymer constituting the plastic film include cellulose ester (such as triacetyl cellulose and diacetyl cellulose), polyamide, polycarbonate, polyester (such as polyethylene terephthalate and polyethylene naphthalate), polystyrene, and polyolefin.

As having been described, in the gravure coating apparatus 100 according to the invention, the extended tip end part 25*b* of the part (dam block) 25 where the outer peripheral surface of the gravure roll moves out is positioned at such a point that is above the axial center O of the gravure roll 15 and forms an center angle θ of 40° or less between the extended tip end part 25*b* of the part 25 where the outer peripheral surface of the gravure roll moves out and the scraping point 23*a* where the redundant part of the coating solution is scraped off with the doctor blade with respect to the axial center O of the gravure roll 15, and a vertical distance h of from 3 to 25 mm between the scraping point 23*a* where the redundant part of the coating solution is scraped off with the doctor blade and the extended tip end part 25*b*. The center angle θ is preferably from 10 to 30°, still preferably from 10 to 20°. Also, The vertical distance h is preferably from 5 to 20 mm, still preferably 7 to 15 mm. Furthermore, the extended tip end part 25*b* is extended upward to increase the gap formed with the outer peripheral surface of the gravure roll 15. According to the constitution, the fluxes Ls in longitudinal stripe form of redundant part of the coating solution L in the longitudinal direction, which are caused by scraping off the coating solution with the doctor blade 23, can be largely suppressed from occurring by selecting the positional relationship of the gravure roll 15 opposed to the extended tip end part 25*b* of the part 25 where the outer peripheral surface of the gravure roll moves out and the doctor blade 23. The increasing gap between the outer peripheral surface of the gravure roll 15 and the part 25 where the outer peripheral surface of the gravure roll moves out of the manifold block 13 relaxes the influence of the viscosity of the coating solution L. Consequently, the coating solution can be uniformly transferred and coated on the surface of the flexible strip support to improve the coating quality.

According to the constitution, not only the fluxes Ls in longitudinal stripe form of redundant part of the coating solution L in the longitudinal direction, which are caused by scraping off the coating solution with the doctor blade 23, can be largely suppressed from occurring by the part 25 where the outer peripheral surface of the gravure roll moves out, but also the deformation of the doctor blade 23 due to the liquid pressure deviation in the coating width direction of the pressurized coating solution L can be suppressed from occurring, whereby the coating solution can be uniformly transferred and coated on the surface of the flexible strip support to improve the coating quality.

Although the gravure coating apparatus 100 of the embodiment employs the reverse coating system (reverse kiss coating system) as an example, in which the gravure roll 15 and the flexible strip support 21 are rotated in direction opposite to each other, the forward coating system (forward kiss coating system) can also be similarly practiced in such a manner that the gravure roll 15 is rotationally driven in the same direction as the conveying direction of the flexible strip support 21, and the doctor blade 23 is disposed on the upstream side of the rotation. Furthermore, such coating systems can be practiced as the forward rotation direct gravure system and the reverse rotation direct gravure system, in which a backup roll is provided on the side opposite to the coating surface of the support.

EXAMPLE 1

As Examples 1 to 7, the inner peripheral surfaces 25*a* and 27*a* of the part 25 where the outer peripheral surface of the gravure roll moves out and the part 27 where the outer peripheral surface of the gravure roll moves in were extended upward to points above the axial center O of the gravure roll 15 to increase the gap G1 to the gap G2 formed with the outer peripheral surface of the gravure roll 15, and the extended tip end part 25*b* of the part 25 where the outer peripheral surface of the gravure roll moves out is positioned at such a point that forms an angle θ of from 10 to 40° between the extended tip end part 25*b* and the scraping point 23*a* of the doctor blade 23 with respect to the axial center O of the gravure roll 15. As Comparative Examples 1 to 4, such a configuration was employed that the angle θ exceeds 40°. The occurrence of transferring and coating unevenness of the coating solution L on the flexible strip support 21 was evaluated for the examples and comparative examples under various conditions. The results are shown in Table 1 below.

TABLE 1

| | Peripheral velocity ratio | Dam block 25 | Dam block 27 | Angle between scraping point and tip end of dam block | Visual observation results under blade | Result of coating |
|---|---|---|---|---|---|---|
| Example 1 | 0.6 | present | present | 10 | no stripe flux | no thickness unevenness |
| Example 2 | 0.6 | present | present | 20 | no stripe flux | no thickness unevenness |
| Example 3 | 0.6 | present | present | 30 | weak stripe fluxes | slight thickness unevenness in stripe form |
| Example 4 | 0.6 | present | present | 40 | weak stripe fluxes | slight thickness unevenness in stripe form |
| Comparative Example 1 | 0.6 | present | present | 45 | stripe fluxes present | retarded thickness unevenness in stripe form |
| Example 5 | 1.0 | present | present | 20 | no stripe flux | no thickness unevenness |
| Example 6 | 1.0 | present | present | 30 | no stripe flux | no thickness unevenness |
| Example 7 | 1.0 | present | present | 40 | weak stripe fluxes | slight thickness unevenness in stripe form |
| Comparative Example 2 | 1.0 | present | present | 45 | strong stripe flux present | retarded thickness unevenness in stripe form |
| Comparative Example 3 | 1.0 | none | present | about 50 | strong stripe flux present | retarded thickness unevenness in stripe form |
| Comparative Example 4 | 1.0 | none | present | about 50 | strong stripe flux present | retarded thickness unevenness in stripe form |

The basic specification of the gravure coating apparatus was as follows.

(Basic Specification)

Outer diameter D of gravure roll: 50 mm

Mesh M of gravure roll: #200

Difference in angle (ϕ−θ): 10 to 45°

Coating system: reverse coating system (reverse kiss coating system)

Peripheral velocity ratio of gravure roll and flexible strip support: 0.6 to 1.0

Angle of doctor blade (ϕ): 50°
Coating speed: 10 m/min
Material of flexible strip support: polyethylene terephthalate (PET) (thickness: 100 μm)

The coating solution was prepared in the following manner. 217.0 g of a coating solution for a hard coat containing a zirconium oxide dispersion (particle diameter: ca. 30 nm) (KZ-7991, a trade name, produced by JSR Corp.) was added to a mixed solvent containing 104.1 g of cyclohexane and 61.3 g of methyl ethyl ketone to form a solution. 5 g of crosslinked polystyrene particles having an average particle diameter of 2 μm (SX-200H, a trade name, produced by Soken Chemical Co., Ltd.) were added to the solution, and after stirring and dispersing with a high-speed device at 5,000 rpm for 1 hour, the solution was filtered through a polypropylene filter having a pore diameter of 30 μm, so as to prepare a coating solution.

Viscosity: 0.005 N·s/M$^2$
Surface tension: 0.033 N/m
Coated amount: 5 cc/M$^2$

It was understood from the result shown in Table 1 that in Comparative Examples 1 and 2 having an angle θ of 45°, fluxes in stripe form were visually observed on the downstream side of the doctor blade 23, and significant thickness unevenness occurred upon coating.

In Comparative Examples 3 to 5 having no part 25 where the outer peripheral surface of the gravure roll moved out (dam block), transferring and coating unevenness occurred.

In Examples 1 to 7 having the part 25 where the outer peripheral surface of the gravure roll moved out and the part 27 where the outer peripheral surface of the gravure roll moved in (dam blocks) and having an angle θ of 40° or less, on the other hand, no or only slight coating unevenness occurred.

EXAMPLE 2

As Examples 8 to 15, the inner peripheral surfaces 25*a* and 27*a* of the part 25 where the outer peripheral surface of the gravure roll moves out and the part 27 where the outer peripheral surface of the gravure roll moves in were extended upward to points above the axial center O of the gravure roll 15 to increase the gap G1 to the gap G2 formed with the outer peripheral surface of the gravure roll 15, and the extended tip end part 25*b* of the part 25 where the outer peripheral surface of the gravure roll moves out is positioned at such a point that forms a vertical distance h of from 3 to 25 mm with respect to the scraping point 23*a* of the doctorblade 23. As Comparative Examples 6 and 7, such a configuration was employed that the vertical distance h exceeding 25 mm. The same evaluation was carried out as in Example 1. The results are shown in Table 2 below.

TABLE 2

| | Peripheral velocity ratio | Dam block 25 | Dam block 27 | Vertical distance h (mm) between scraping point and tip end of dam block | Visual observation results under blade | Result of coating |
|---|---|---|---|---|---|---|
| Example 8 | 0.6 | present | present | 3 | no stripe flux (liquid pool under blade disturbed) | no thickness unevenness |
| Example 9 | 0.6 | present | present | 7 | no stripe flux | no thickness unevenness |
| Example 10 | 0.6 | present | present | 15 | no stripe flux | no thickness unevenness |
| Example 11 | 0.6 | present | present | 25 | weak stripe fluxes | slightly retarded thickness unevenness in stripe form |
| Comparative Example 6 | 1.0 | present | present | 35 | stripe fluxes present | retarded thickness unevenness in stripe form |
| Example 12 | 1.0 | present | present | 3 | no stripe flux (liquid pool under blade disturbed) | no thickness unevenness |
| Example 13 | 1.0 | present | present | 7 | no stripe flux | no thickness unevenness |
| Example 14 | 1.0 | present | present | 15 | no stripe flux | no thickness unevenness |
| Example 15 | 1.0 | present | present | 25 | weak stripe fluxes | no thickness unevenness |
| Comparative Example 7 | 1.0 | present | present | 35 | strong stripe flux present | retarded thickness unevenness in stripe form |

The basic specification of the gravure coating apparatus was as follows.

(Basic Specification)
Outer diameter D of gravure roll: 100 mm
Mesh M of gravure roll: #200
Angle of doctor blade (ϕ): 45°
Coating system: reverse coating system (reverse kiss coating system)
Peripheral velocity ratio of gravure roll and flexible strip support: 0.6 to 1.0
Coating speed: 20 m/min
Material of flexible strip support: polyethylene terephthalate (PET) (thickness: 100 μm)

The coating solution was prepared in the following manner. 217.0 g of a coating solution for a hard coat containing a zirconium oxide dispersion (particle diameter: ca. 30 nm) (KZ-7991, a trade name, produced by JSR Corp.) was added to a mixed solvent containing 104.1 g of cyclohexane and 61.3 g of methyl ethyl ketone to form a solution. 5 g of crosslinked polystyrene particles having an average particle diameter of 2 μm (SX-200H, a trade name, produced by Soken Chemical Co., Ltd.) were added to the solution, and after stirring and dispersing with a high-speed device at 5,000 rpm for 1 hour, the solution was filtered through a polypropylene filter having a pore diameter of 30 μm, so as to prepare a coating solution.

Viscosity: 0.005 N·s/m$^2$

Surface tension: 0.033 N/m
Coated amount: 5 cc/$M^2$

It was understood from the result shown in Table 2 that in Examples 8 to 15 having a vertical distance h of from 3 to 25 mm, no transferring and coating unevenness occurred, and in Comparative Examples 6 and 7 having a vertical distance h of 35 mm, transferring and coating unevenness occurred.

EXAMPLE 3

The evaluation for coating conditions by the forward kiss coating system was carried out in the same manner as in Example 1, in which the inner peripheral surfaces 25*a* and 27*a* of the part 25 where the outer peripheral surface of the gravure roll moves out and the part 27 where the outer peripheral surface of the gravure roll moves in were extended upward to points above the axial center O of the gravure roll 15 to increase the gap G1 to the gap G2 formed with the outer peripheral surface of the gravure roll 15, and the vertical distance h between the extended tip end part 25*b* of the part 25 where the outer peripheral surface of the gravure roll moves out and the scraping point 23*a* of the doctor blade 23 was changed. The results are shown in Table 3 below.

TABLE 3

| | Dam block 25 | Dam block 27 | Vertical distance h (mm) between scraping point and tip end of dam block | Visual observation results under blade | Result of coating |
|---|---|---|---|---|---|
| Example 16 | present | present | 7 | no stripe flux | no thickness unevenness |
| Example 17 | present | present | 15 | no stripe flux | no thickness unevenness |
| Example 18 | present | present | 25 | weak stripe fluxes | no thickness unevenness |
| Comparative Example 8 | present | present | 35 | stripe fluxes present | retarded thickness unevenness in stripe form |
| Comparative Example 9 | none | present | 45 | stripe fluxes present | retarded thickness unevenness in stripe form |

The basic specification of the gravure coating apparatus was as follows.

(Basic Specification)
Outer diameter D of gravure roll: 100 mm
Mesh M of gravure roll: #180
Coating system: forward kiss coating system
Peripheral velocity ratio of gravure roll and flexible strip support: 1.0
Coating speed: 10 m/min
Material of flexible strip support: polyethylene terephthalate (PET) (thickness: 100 μm)

The coating solution was prepared in the following manner. 217.0 g of a coating solution for a hard coat containing a zirconium oxide dispersion (particle diameter: ca. 30 nm) (KZ-7991, a trade name, produced by JSR Corp.) was added to a mixed solvent containing 104.1 g of cyclohexane and 61.3 g of methyl ethyl ketone to form a solution. 5 g of crosslinked polystyrene particles having an average particle diameter of 2 μm (SX-200H, a trade name, produced by Soken Chemical Co., Ltd.) were added to the solution, and after stirring and dispersing with a high-speed device at 5,000 rpm for 1 hour, the solution was filtered through a polypropylene filter having a pore diameter of 30 μm, so as to prepare a coating solution.

Viscosity: 0.005 N·s/$m^2$
Surface tension: 0.033 N/m
Coated amount: 5 cc/$M^2$

It was understood from the result shown in Table 3 that in Examples 16 to 18 having a vertical distance h of from 7 to 25 mm, no transferring and coating unevenness occurred, and in Comparative Examples 8 and 9 having a vertical distance h of from 35 to 45 mm, transferring and coating unevenness occurred.

This application is based on Japanese Patent application JP2004-212634, filed Jul. 21, 2004, the entire content of which is hereby incorporated by reference. This claim for priority benefit is being filed concurrently with the filing of this application.

What is claimed is:

1. A gravure coating apparatus, comprising:

a gravure roll that is rotationally driven at a peripheral velocity;

a manifold block that continuously coats a coating solution on an outer peripheral surface of the gravure roll by immersing a lower part of the outer peripheral surface in the coating solution;

a doctor blade that scrapes off a redundant part of the coating solution coated on the outer peripheral surface from an upper part of the outer peripheral surface of the gravure roll rotationally displaced upward having the coating solution coated thereon; and a dam block extending from the manifold block on a side where the outer peripheral surface of the gravure roll moves out from the manifold block by rotation of the gravure roll, wherein a tip end of the dam block is disposed above an axial center of the gravure roll and below a scraping point where the redundant part of the coating solution on the outer peripheral surface of the gravure roll is scraped off with the doctor blade, wherein a difference between the tip end and the scraping point is from 3 to 25 mm in a vertical direction, and wherein the gravure roll has a diameter of from 20 to 300 mm.

2. The gravure coating apparatus according to claim 1, wherein a first line connecting the tip end and the axial center, and a second line connecting the scraping point and the axial center defines an angle between the first line and the second line being 40° or less.

3. The gravure coating apparatus according to claim 1, wherein a first line connecting the tip end and the axial center and a second line connecting the scraping point and the axial center defines an angle between the first line and the second line being from 10 to 30°.

4. The gravure coating apparatus according to claim 1, wherein a first line connecting the tip end and the axial center and a second line connecting the scraping point and the axial center defines an angle between the first line and the second line being from 10 to 20°.

5. The gravure coating apparatus according to claim 1, wherein a difference between the tip end and the scraping point is from 5 to 20 mm in a vertical direction.

6. The gravure coating apparatus according to claim 1, wherein a difference between the tip end and the scraping point is from 7 to 15 mm in a vertical direction.

7. The gravure coating apparatus according to claim 1, wherein the gravure roll is rotationally driven in a direction opposite to a conveying direction of a support.

8. The gravure coating apparatus according to claim 1, wherein the gravure roll is rotationally driven in a same direction as a conveying direction of a support.

9. The gravure coating apparatus according to claim 1, wherein the dam block is provided at least on an upstream side of a rotation direction of the gravure roll.

10. The gravure coating apparatus according to claim 1, further comprising:

solution outflow preventing plates disposed on both ends of a space formed by the dam block and the gravure roll.

11. A gravure coating apparatus, comprising:

a gravure roll that is rotationally driven at a peripheral velocity;

a manifold block that continuously coats a coating solution on an outer peripheral surface of the gravure roll by immersing a lower part of the outer peripheral surface in the coating solution;

a doctor blade that scrapes off a redundant part of the coating solution coated on the outer peripheral surface from an upper part of the outer peripheral surface of the gravure roll rotationally displaced upward having the coating solution coated thereon; and a dam block that is formed to extend from the manifold block on a side where the outer peripheral surface of the gravure roll moves out from the manifold block by rotation of the gravure roll, wherein a tip end of the dam block is disposed above an axial center of the gravure roll and below a scraping point where the redundant part of the coating solution on the outer peripheral surface of the gravure roll is scraped off with the doctor blade, and wherein the dam block extends upward with an upwardly increasing gap between the outer peripheral surface of the gravure roll and the dam block measured in a direction radially of the gravure roll.

12. The gravure coating apparatus according to claim 11, wherein a first line connecting the tip end and the axial center, and a second line connecting the scraping point and the axial center, defines an angle between the first line and the second line being 40° or less.

13. The gravure coating apparatus according to claim 11, wherein a first line connecting the tip end and the axial center and a second line connecting the scraping point and the axial center defines an angle between the first line and the second line being from 10 to 30°.

14. The gravure coating apparatus according to claim 11, wherein a difference between the tip end and the scraping point is from 5 to 20 mm in a vertical direction.

15. The gravure coating apparatus according to claim 11, wherein a difference between the tip end and the scraping point is from 7 to 15 mm in a vertical direction.

16. The gravure coating apparatus according to claim 11, wherein the gravure roll is rotationally driven in one of i) a direction opposite to a conveying direction of a support, and ii) a same direction as the conveying direction of a support.

17. The gravure coating apparatus according to claim 11, wherein the dam block is provided at least on an upstream side of a rotation direction of the gravure roll.

18. The gravure coating apparatus according to claim 11, wherein the gravure roll has a diameter of from 20 to 300 mm.

19. The gravure coating apparatus according to claim 11, further comprising:

solution outflow preventing plates disposed on both ends of a space formed by the dam block and the gravure roll.

* * * * *